US006790074B1

(12) United States Patent
Chiu

(10) Patent No.: US 6,790,074 B1
(45) Date of Patent: Sep. 14, 2004

(54) ELECTRICAL POWER CONNECTOR FOR FLEXIBLE CIRCUIT BOARD

(75) Inventor: Hsien-Yu Chiu, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 10/457,421

(22) Filed: Jun. 10, 2003

(30) Foreign Application Priority Data

Mar. 14, 2003 (TW) ..... 92203974 U

(51) Int. Cl.[7] ..... H01R 12/24
(52) U.S. Cl. ..... 439/495; 439/260; 439/329
(58) Field of Search ..... 439/495, 329, 439/260, 325

(56) References Cited

U.S. PATENT DOCUMENTS 5,580,272 A * 12/1996 Yamaguchi et al. ..... 439/495
6,099,346 A * 8/2000 Hashiguchi et al. ..... 439/495
6,116,947 A * 9/2000 Takayasu ..... 439/495
6,171,137 B1 * 1/2001 Hatakeyama ..... 439/495
6,224,418 B1 * 5/2001 Miura et al. ..... 439/495
6,602,083 B2 * 8/2003 Tsunematsu ..... 439/260
6,619,979 B1 * 9/2003 Yu-Feng ..... 439/495

* cited by examiner

*Primary Examiner*—Ross Gushi
(74) *Attorney, Agent, or Firm*—Troxell Law Office PLLC

(57) ABSTRACT

An electrical power connector for flexible circuit boards capable of ensuring that free rotations of a mobile cover thereof and a base thereof are maintained even if a pivotal axis thereof is fractured, while also providing a flexible circuit board thereof with pressing and connection effects. One side of the positioning axis defines the close position of the mobile cover for pressing and connecting a flexible circuit board and forming an electrically connected pressure portion with a contact arm of the terminal. The points of displacement of the pressure portion from the open position to the close position do not exceed a line from a center of the support portion of the support arm to the contact fin of the contact arm for electrically connecting the flexible circuit board.

5 Claims, 7 Drawing Sheets

ELECTRICAL POWER CONNECTOR FOR FLEXIBLE CIRCUIT BOARD

BACKGROUND OF THE INVENTION (a) Field of the Invention

The invention relates to an electrical power connector for flexible circuit boards, and more particularly, to an electrical power connector for inserting and applying in flexible circuit boards, and producing electrical connection for terminals using a mobile cover thereof providing downward pressure.

(b) Description of the Prior Art

Referring to a prior art disclosed in the Taiwan Patent Publication No. 233382, Electrical Power Connector for Flexible Motherboards, the prior invention mainly provides a connector adapted to accommodate miniaturization of electrical products. This prior connector is capable of maintaining a connected state without any clutch pallet portions and clutch block portions, or any other fastening devices. This prior invention comprises a cover-like pressure member provided between a stabilized position (close position) approaching contacts therein and an open position departing from the stabilized position, and the cover-like pressure member is supported by a rotation and supporting portion provided at a housing for free rotations. The pressure member is further provided with a pressure protrusion that downwardly presses a flexible substrate placed at the contacts when rotated to the aforesaid stabilized position Referring to appended FIGS. 1 to 7, when the pressure member is at the open position, the pressure portion is at an exterior of a line formed from a rotation center of the rotation and supporting portion to contact portions of the contacts. When the pressure member is rotated to the stabilized position, the pressure portion exceeds the aforesaid line. Therefore, the technical characteristics of the prior invention yet has the following issues to be solved:

1. The rotation mode in this prior invention is accomplished by downwardly pressing and rotating the pressure member along the connected rotation and supporting portion of the contacts. For that support and connection can merely rely on an axis portion thereof, the pressure member is likely to fall off. Especially in occurrence of cracking of the axis portion of the pressure member, a rotation groove therein becomes deprived of support and then separates from the contacts. It is rather inappropriate considering usage of a connector having inserted and replaced connector substrates. In addition, the axis portion forms a flexible arm portion at an indenture of the pressure element that has a relatively small volume, and hence the flexible arm portion is inadequate for preventing breakage during assembly. Therefore, it is a primary task as how to improve flexibility during assembly and to provide a more effective rotation mode for ensuring electric connection.
2. When the contacts are assembled at the housing, it is frequent that terminals thereof are unable to be arranged in level due to minute accuracy errors. This then leads to failures of absolute assurance of having contact portions of the contacts evenly and entirely join with the rotation groove. In case of larger errors, interferences during contacts of the support portion and the rotation groove further affect the axis portion of the pressure member to be properly entered and positioned in an axis support portion. Consequently, actual rotations are virtually unaccomplished. The aforesaid issues remains a second task to be solved.

SUMMARY OF THE INVENTION

The primary object of the invention is to provide an electrical power connector that overcomes the aforesaid disadvantages. The present invention ensures that free rotations of a mobile cover thereof and a base thereof are maintained even if a pivotal axis thereof is fractured, while also being able to provide a flexible circuit board thereof with pressing and connection effects. An activity opening for movements from an open position thereof to a close position thereof is provided at a mobile cover thereof and for corresponding to a support arm of a terminal located within a base thereof. The activity opening is also disposed with a positioning axis at a position receiving the support arm. One side of the aforesaid positioning axis defines the close position of the mobile cover for pressing and connecting a flexible circuit board and forms an electrically connected pressure portion with a contact arm of the terminal, and the contact arm of the terminal is provided with a contact fin electrically connected with the flexible circuit board. Using the aforesaid structure, the invention provides solutions as the following:

1. Assembly: The activity opening is left with a certain margin, and therefore interferences are not produced even if errors occur during assembly the contact terminals. Also, two side walls of the base are defined as side walls having flexible assembly because of horizontal groove gaps and vertical groove gaps provided. The side walls are further disposed with inclined guiding planes and wedge channels at an entrance thereof, and the mobile cover is disposed with block members corresponding to the aforesaid wedge channels, such that when the mobile cover is pushed into the aperture, the pivotal axes smoothly enter the pivotal grooves, thereby elevating conveniences in assembly of the mobile cover as well as effectively lowering a difficulty of controlling errors of the terminals.
2. Activity: The present invention utilizes the positioning axis to press against a support portion of the support arm, and activities of the terminals from the open position to the close position are restricted using the activity opening. The positioning axis and the support portion are further respectively provided with a protrusion and an indenture that restrain each other, and containment of the aforesaid mobile cover is yet maintained when fractures are caused by inappropriate forces applied by a user or other reasons, thereby ensuring pressing effects of the connector at the close position without needing to replace the connector.

BRIEF DESCRIPTION OF THE DRAWINGS

FIG. 5–1 shows a schematic view illustrating the open position of the mobile cover according to the invention.

FIG. 5–2 shows a schematic view illustrating the mobile cover pressing downward to the close position according to the invention.

FIG. 5–3 shows schematic view illustrating the close position of the mobile cover according to the invention.

DETAILED DESCRIPTION OF THE PREFERRED EMBODIMENTS

Figure 1:
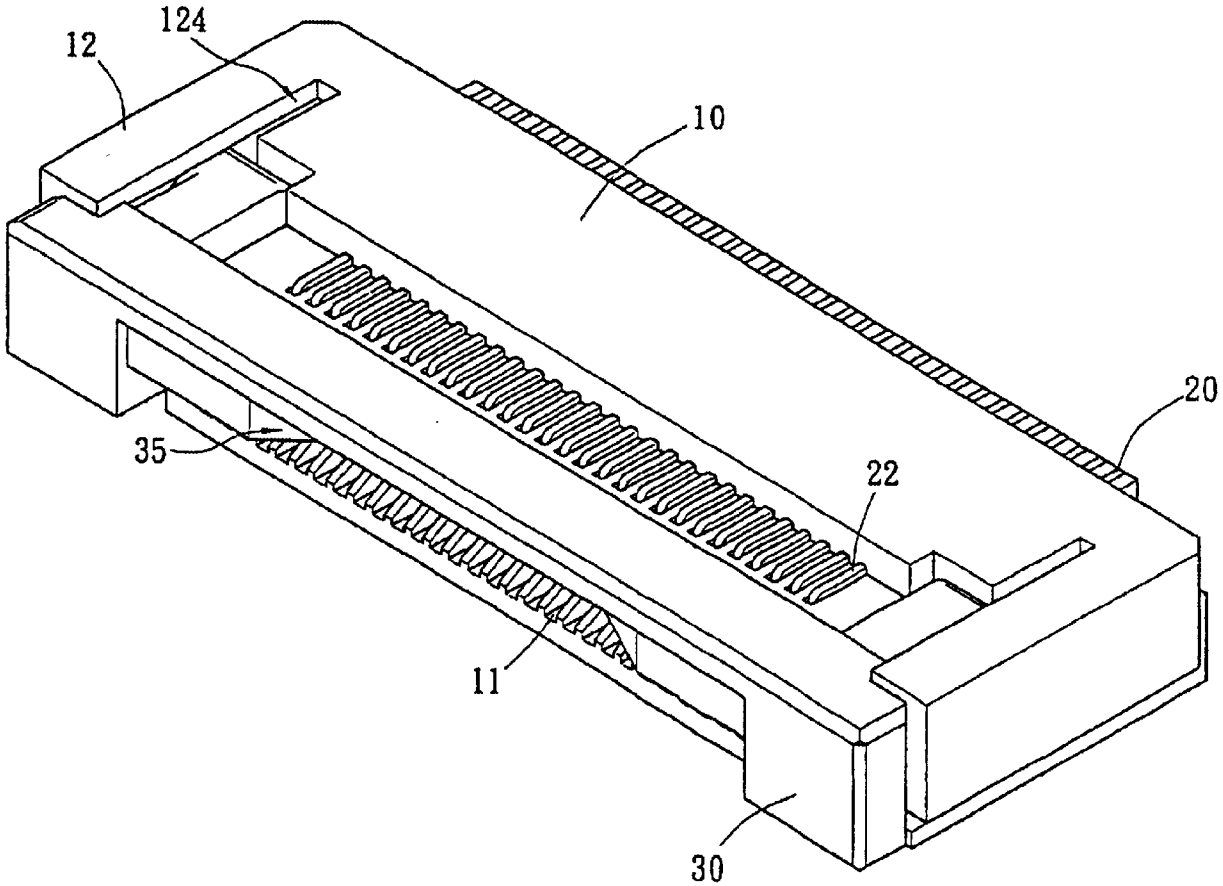
FIG. 1 shows an elevational schematic view according to the invention.
Figure 2:
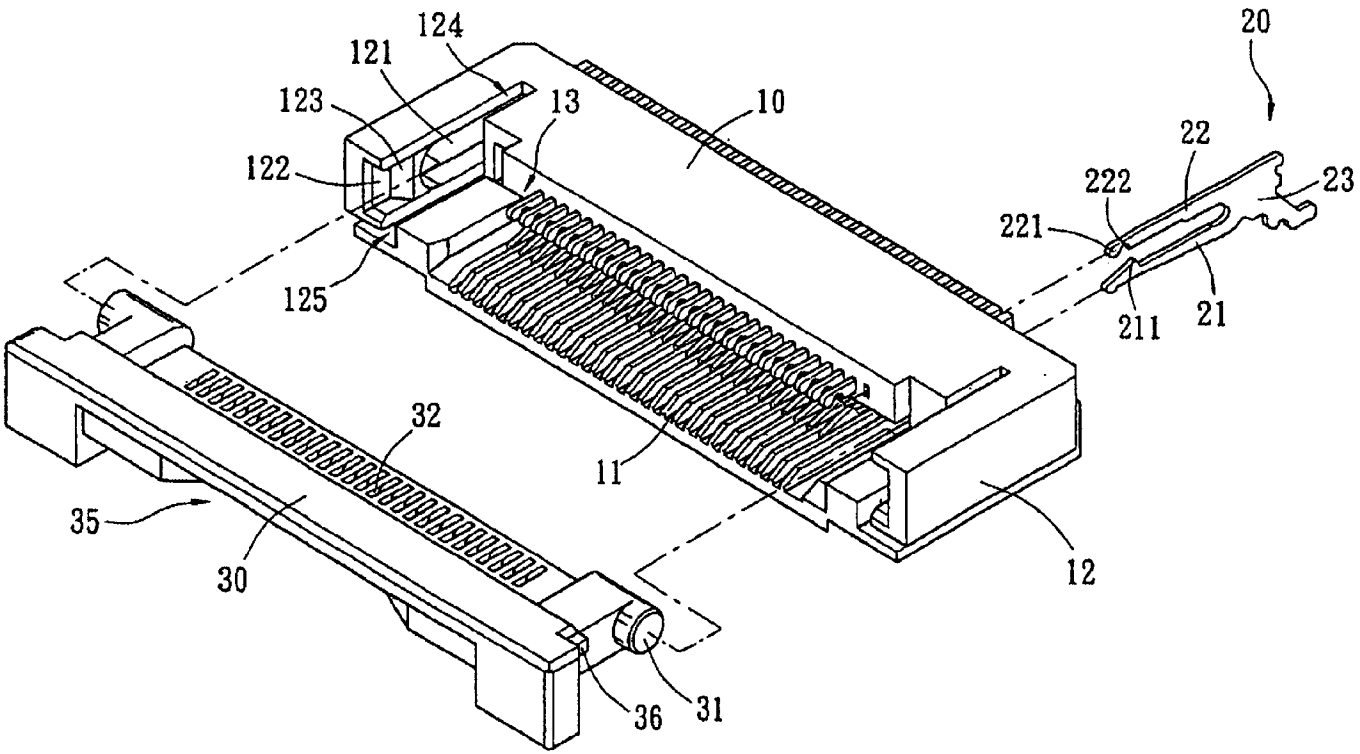
FIG. 2 shows an exploded structural schematic view according to the invention.

To better understand the technical contents of the invention, descriptions shall be given with the accompanying drawings hereunder. Referring to FIGS. 1 and 2 showing an elevational schematic view and an exploded structural schematic view according to the invention, respectively, the invention comprises:

a base 10 having an aperture 13, and a plurality of placement partitions 11 defined by terminals 20 arranged;

each of the aforesaid terminals 20 having a support arm 22 assembled and exposed at an upper surface of the base 10, a contact arm 21 located in the placement partition 11 and extended to the aperture 13, and a connection arm 23 connecting the support arm 22 and the contact arm 21; and a mobile cover 30 provided at the aperture 13 of the base 10, and having a pivotal axis 31 corresponding to a pivotal groove 131 of the aperture 13, an activity opening 32 corresponding to the support arm 22 of the terminal 20 and for restricting movements from an open position to a close position of the mobile cover 30, and a positioning axis 33 at a position where the activity opening 32 receives the support arm 22 (refer to FIG. 4); wherein:

the positioning axis 33, and a support portion 221 formed at an end of the support arm 22 of the terminal 20, are provided with a protrusion 331 and an indenture 222 that restrain each other, one side of the aforesaid positioning axis 33 defines a close position of the mobile cover 30 for pressing and connecting a flexible circuit board 40 (refer to FIG. 5–1) and forms an electrically connected pressure portion 34 with the contact arm 21 of the terminal 20, and the contact arm 21 of the terminal 20 is provided with a contact fin 211 electrically connected with the flexible circuit board 40.

Figure 3:
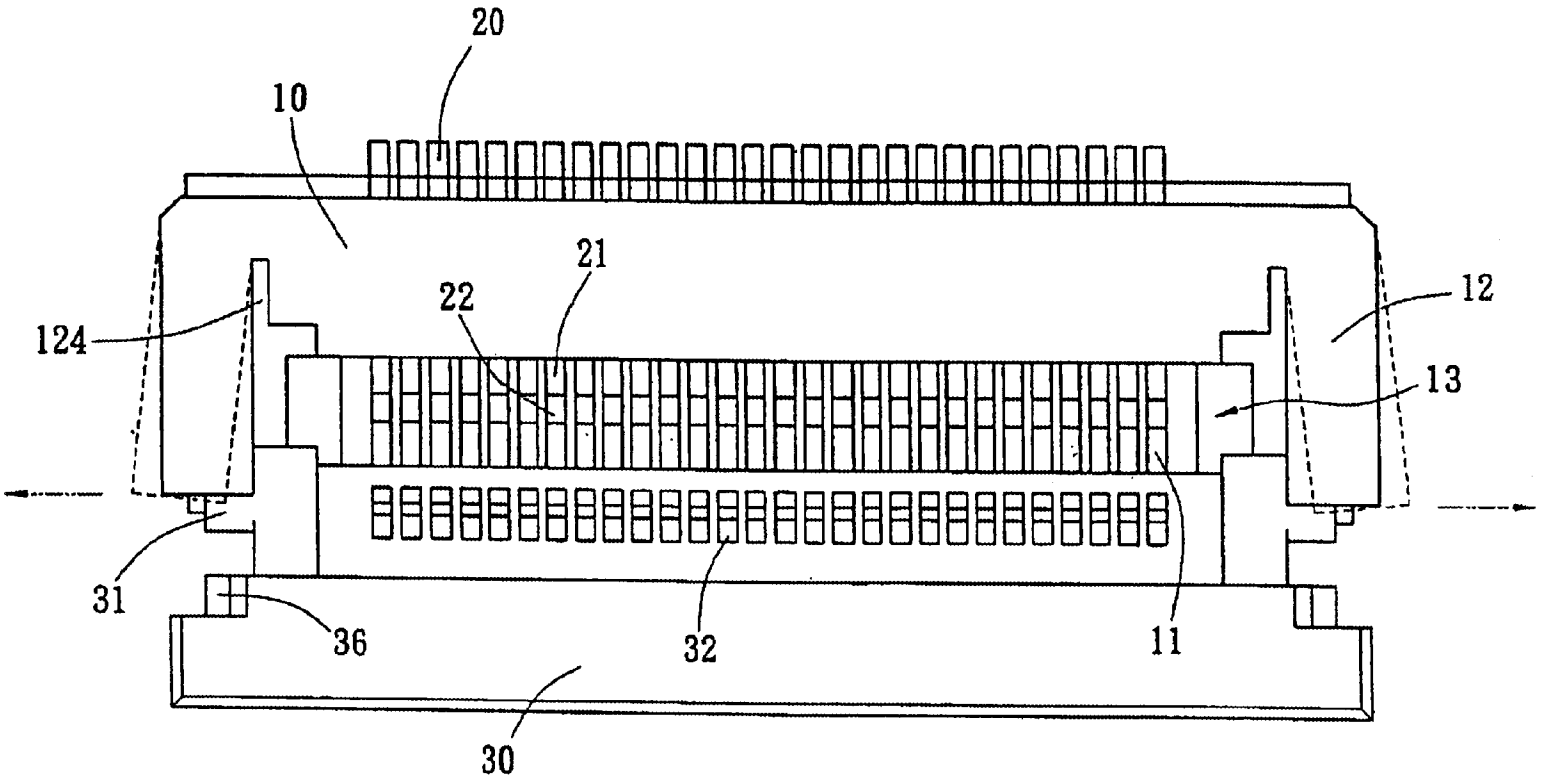
FIG. 3 shows a top schematic view illustrating the mobile cover according to the invention.
Figure 4:
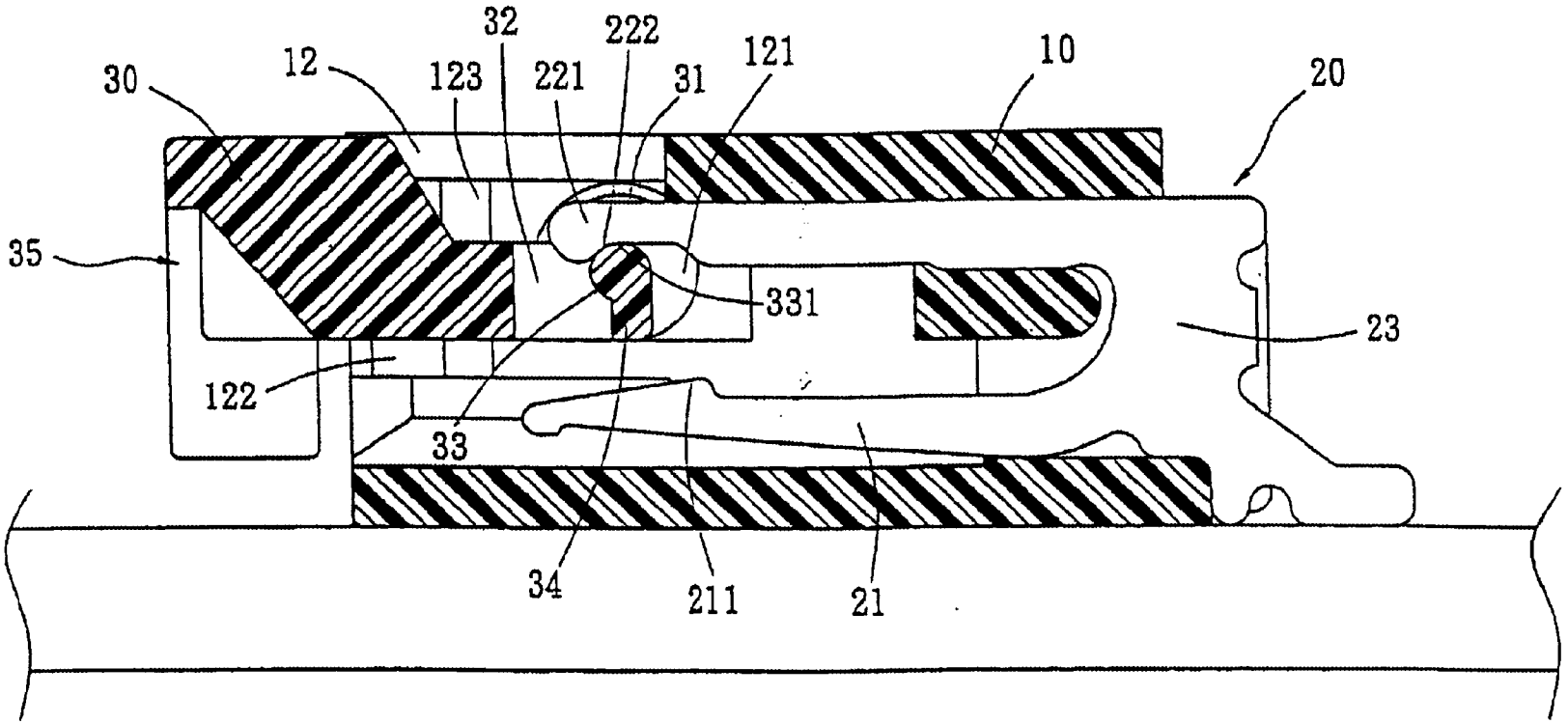
FIG. 4 shows a sectional schematic view illustrating the mobile cover according to the invention.

Referring to FIGS. 2 and 3 showing schematic view illustrating assembly of the mobile cover 30 according to the invention, two side walls 12 of the base 10 having pivotal grooves 121 are defined as side walls 12 having flexible assembly because of horizontal groove gaps 125 and vertical groove gaps 124 reserved. Also, owing to inclined guiding planes 123 and wedge channels 122 disposed at entrances of the side walls 12, when the mobile cover 30 is horizontally pushed into the aperture 13 of the base 10, a distance between the two side wedge channels 122 is slightly larger than a distance between two side pivotal axes 32 of the mobile cover 30. The mobile cover 30 then smoothly enters the wedge channels 122 to further enter the base 10 along the inclined guiding planes 123. The side walls 12 are provided with flexibility because of the horizontal groove gaps 125 and the vertical groove gaps 124, and therefore appropriate deformation is given when being squeezed by the mobile cover 30 pushed in. However, when the pivotal axes 31 of the mobile cover 30 are assuredly placed into the pivotal grooves 121, the side walls 12 are again restored to original shapes thereof due to the provided flexibility. Referring to FIG. 4, when the pivotal axes 31 of the mobile cover 30 are placed into the pivotal grooves 121, the support arm 22 of the terminal 20 enters the activity opening 32 of the mobile cover 30. Hence, even if errors occur during assembly of the support arm 22 of the terminal 20, assembly of the pivotal axes 31 is left unaffected. At this point, the positioning axis 33 enters a bottom end of the support portion 221, and the protrusion 331 is joined with the indenture 222. That is, apart from positioning effects given by the pivotal axes 31 at the pivotal grooves 121, a containing relationship formed at the support portion 221 and the positioning axis 33 is additionally offered to each of the terminals 20. As a result, the invention still ensures containment of each of the terminals and the activity opening 32 without affecting activities thereof even when fractures are caused by inappropriate forces applied by a user or other reasons.

Figures 1, 5:
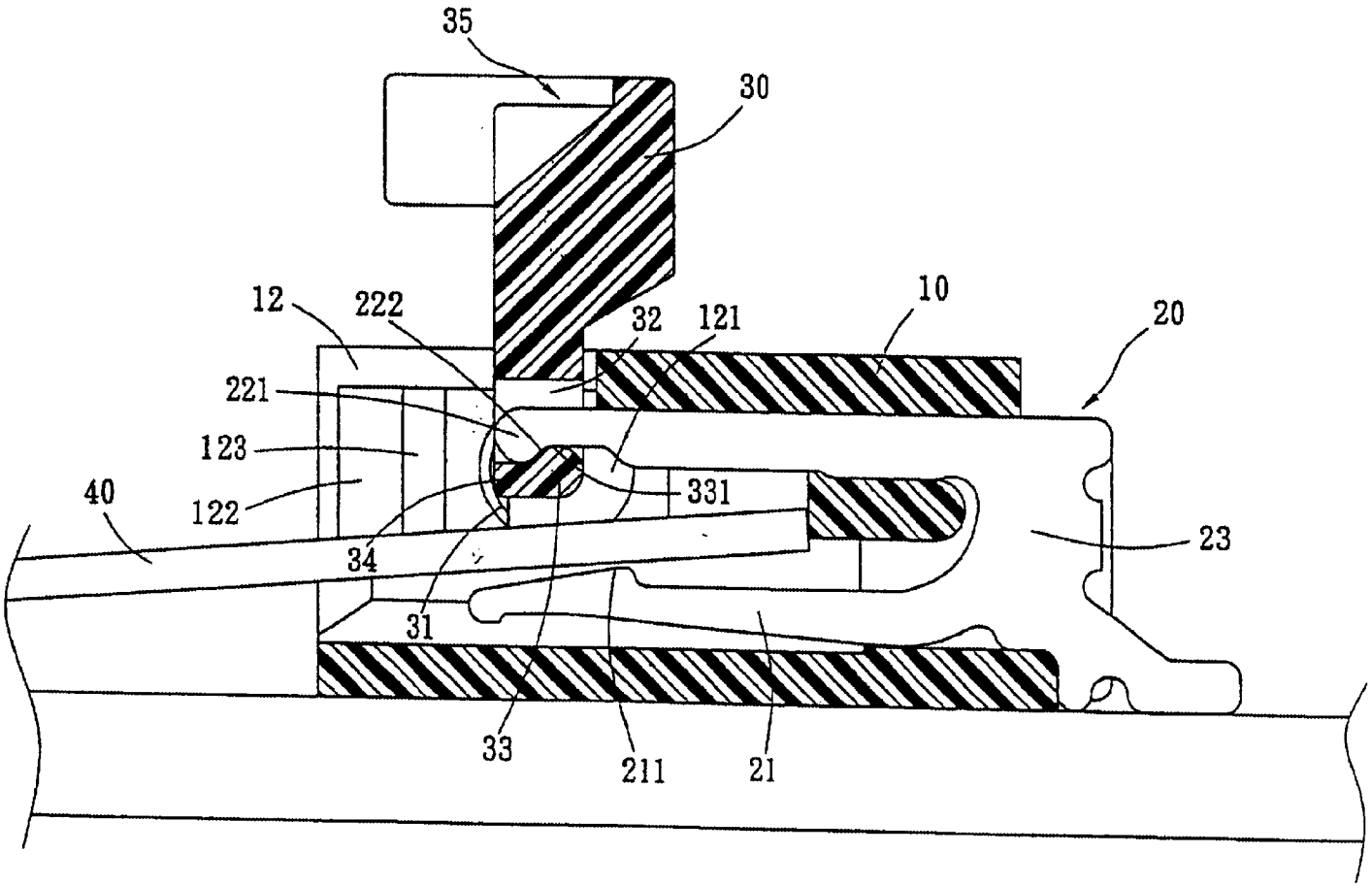
Figures 2, 5:
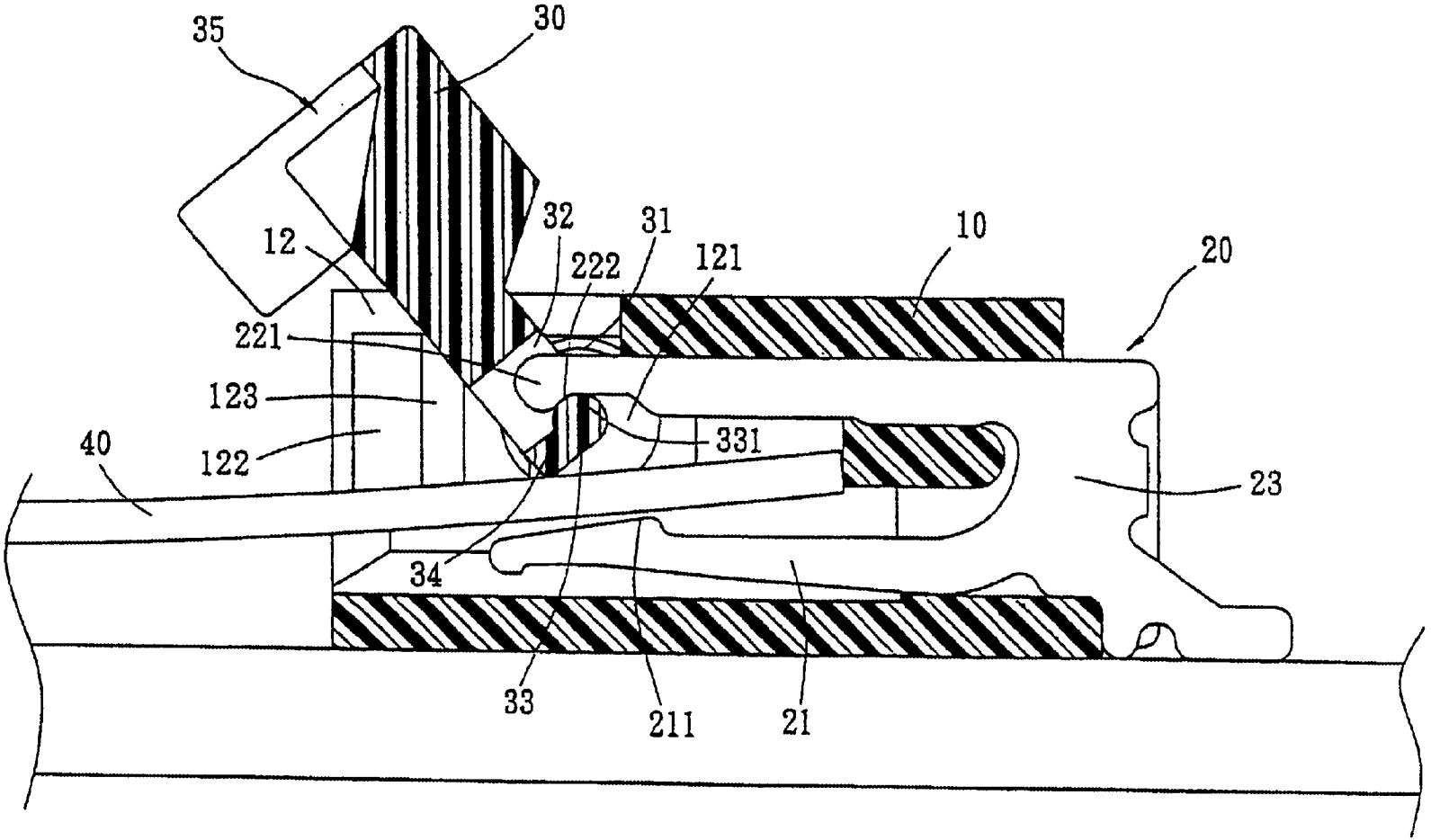
Figures 3, 5:
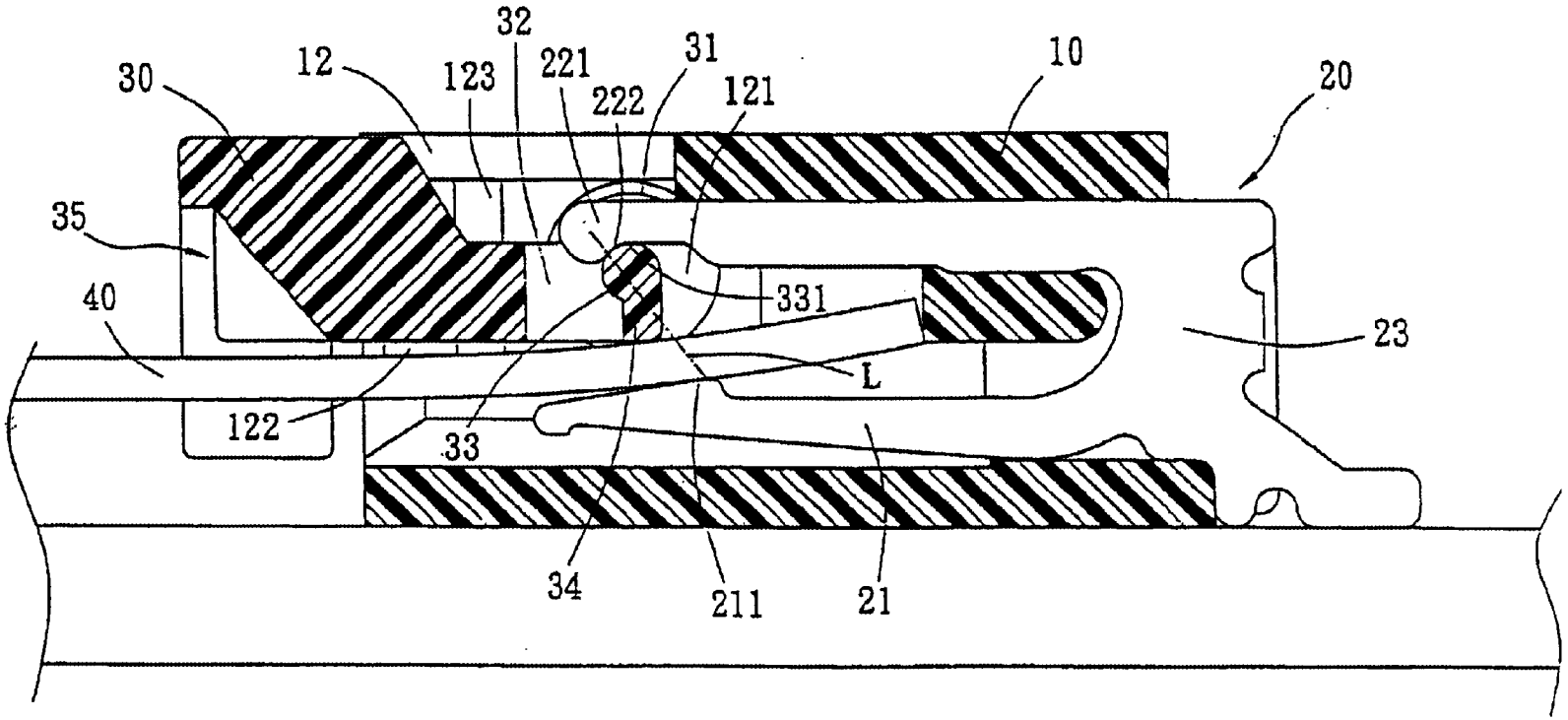

Referring to FIG. 5 showing a schematic view illustrating an open position of the mobile cover 30 according to the invention, when the user carries out an electrical connection for the flexible circuit board 40, the mobile cover 30 is lifted to the open position thereof using the pivotal axes 31 as fulcrums thereof. For the reasons that the activity opening 32 is an open space having a margin, a containing relationship is formed between the protrusion 331 of the positioning axis 33 and the indenture 222 at the support portion 221, and the indenture 222 is further extended with a plane segment, a margin for the assembly of the positioning axis 33 is increased. Moreover, the positioning axis 33 is rotated at the plane segment of the indenture 222 without shifting with the opening of the mobile cover 30. In addition, in order to facilitate the user to apply force for opening the mobile cover 30, a force application point 35 is formed at a recess at a middle section of the mobile cover 30. Referring to FIG. 5–2, when the flexible circuit board 40 enters through the aperture 13 and the mobile cover 30 is pressed downward, the positioning axis 33 is not shifted and yet rotates as a fixed axis, and interferences are not produced during rotations by the support portion 221 at a front end of the support arm 22 because of the margin reserved at the activity opening 32. Referring to FIG. 5–3, the pressure portion 34 of the mobile cover 30 comes into contact with the flexible circuit board 40 at a half-open position, and the mobile cover 30 continues to press downward until reaching the close position. As a result, the pressure portion 34 originally horizontal becomes vertical to the flexible circuit board 40, such that the flexible circuit board 40 is provided with a downward pressure for electrically connecting the flexible circuit board 40 to the contact fin 211 at the contact arm 21 of the terminal 20. Furthermore, the aforesaid wedge channels 122 are disposed with block members 36 that provide further positioning effects when the mobile cover 30 is positioned at the close position. Referring to FIGS. 5–1, 5–2 and 5–3, it is observed that the difference between the present invention and the prior invention disclosed in the Taiwan Patent Publication No. 233382 is that, in the present invention, points of displacement of the pressure 34 from the open position to the close position do not exceed a line L from a center of the support portion 221 of the support arm 22 to the contact fin 211 of the contact arm 21 for electrically connecting the flexible circuit board 40.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An electrical power connector for flexible circuit boards comprising:

a) a plurality of terminals, each of the plurality of terminals having:

i) a contact arm;

ii) a support arm; and iii) a connection arm connected between the contact arm and the support arm;

b) a base having:

i) a plurality of placement partitions;

ii) an aperture, one of the plurality of terminals inserted into the aperture between two adjacent placement partitions; and iii) two flexible side walls, each of the two side walls having a pivotal groove, a horizontal groove gap, a vertical groove gap, a wedge channel and an inclined guiding plane, the inclined guiding plane is located between the pivotal groove and the wedge channel; and c) a mobile cover pivotally connected to the base and having:

i) two pivotal axes, one of the two pivotal axes inserted into each pivotal groove of the two side walls;

ii) a plurality of activity openings into which the support arm of the plurality of terminals are inserted;

iii) a pressure portion;

iv) a positioning axis connected to the pressure portion, wherein the mobile cover is movable between open and closed positions, when the mobile cover is in the open position, the circuit board is inserted into the aperture of the base, and, when the mobile cover is in the closed position, the positioning axis of the mobile cover engages the support arm of the plurality of terminals and the pressure portion of the mobile cover engages the circuit board, and the circuit board is electrically connected to the contact arm of the plurality of terminals; and v) a block member on opposing sides thereof, each block member engaging one wedge channel of the block member, when the mobile cover is in the closed position.

2. The electrical power connector according to claim 1, wherein the support arm of each of the plurality of terminals includes a support portion.

3. The electrical power connector according to claim 1, wherein the support arm of each of the plurality of terminals includes an indenture, the positioning axis of the mobile cover includes a protrusion, the protrusion engaging each indenture.

4. The electrical power connector according to claim 1, wherein each contact arm of the plurality of terminals includes a contact fin.

5. The electrical power connector according to claim 4, wherein points of displacement are between a center of the support portion of each support arm and the contact fin of each contact arm.

* * * * *